US006487842B2

(12) United States Patent
Tanae et al.

(10) Patent No.: US 6,487,842 B2
(45) Date of Patent: Dec. 3, 2002

(54) DRAWING AND TEMPORARY TWISTING MACHINE

(75) Inventors: Fumio Tanae, Ehime (JP); Shunzo Naito, Ehime (JP); Yoshihide Nishimura, Ehime (JP); Mikio Abe, Ehime (JP)

(73) Assignee: Teijin Seiki Co., Ltd., Tokyo (JP)

( * ) Notice: Subject to any disclaimer, the term of this patent is extended or adjusted under 35 U.S.C. 154(b) by 0 days.

(21) Appl. No.: 09/785,823

(22) Filed: Feb. 16, 2001

(65) Prior Publication Data

US 2001/0020356 A1 Sep. 13, 2001

(30) Foreign Application Priority Data

Feb. 16, 2000 (JP) ..... 2000-038796

(51) Int. Cl.[7] ..... D01H 4/02
(52) U.S. Cl. ..... 57/284; 57/350
(58) Field of Search ..... 57/282, 284, 287, 57/288, 290, 291, 332, 333, 334, 337, 338, 339

(56) References Cited

U.S. PATENT DOCUMENTS 4,398,386 A * 8/1983 Endo et al. ..... 57/288

5,644,908 A * 7/1997 Schippers et al. ..... 57/290

* cited by examiner

*Primary Examiner*—John J. Calvert
*Assistant Examiner*—Shaun R Hurley
(74) *Attorney, Agent, or Firm*—Akin, Gump, Strauss, Hauer & Feld, L.L.P.

(57) ABSTRACT

A yarn feeding device including a preheater 23 for preheating a yarn bar Y, a first feed roller 27 for drawing the yarn bar Y from an original yarn package 11 is provided opposite to a temporary twisting and relaxation heat treating device including a second feed roller having a higher circumferential speed than that of the first feed roller 27, a temporary twisting tool 31 for twisting the yarn bar Y and a second heater 35 for carrying out a relaxation heat treatment on the temporary twisted yarn bar Y with a worker passage A interposed therebetween, a first heater 41 and a cooling plate which thermally fix a twist retroacting along the yarn bar Y are provided in portions positioned above from the yarn feeding device to the temporary twisting and relaxation heat treating device, and a winding device 51 including an automatic switching device is provided on an opposite worker passage A side of the temporary twisting and relaxation heat treating device.

10 Claims, 2 Drawing Sheets

PRIOR ART

DRAWING AND TEMPORARY TWISTING MACHINE

BACKGROUND OF THE INVENTION

The present invention relates to a drawing and temporary twisting machine. More particularly, the invention relates to an improvement in a layout of a drawing and temporary twisting machine having a winding device provided with an automatic doffing switching device for automatically switching a package in each weight. A full wound package wound up by the winding device is properly doffed by an autodoffer.

In the drawing and temporary twisting machine, a yarn bar pulled out of an original yarn package is drawn and is simultaneously twisted temporarily or is drawn and is then twisted temporarily, and is thus wound upon the package.

Such a typical device is shown in FIG. 2(*a*). In the device, an original yarn package 11 is carried on a creel stand 10. A temporary twisting tool 31, a second feed roller 32 and a second heater 35 of a tube type are carried on a temporary twist—relaxation heat treating device 30, and a winding device 51 provided with an automatic switching device faces them in opposite directions.

A worker passage A is provided between the winding device 51 and the creel stand 10 mounting the original yarn package. A worker standing on the worker passage A pulls out a yarn bar Y drawn from the original yarn package 11 of the creel stand 10 through a first feed roller 27, and feeds the yam package 11 to the second heater 35 of a tube type positioned on the inner side of the winding device 51 through the second feed roller 32 by using a suction gun (not shown). Consequently, the yam bar is wounded upon the winding device 51 through the second heater 35. Next, the worker winds the yarn bar Y ranging from the first feed roller 27 to the second feed roller 32 upon the temporary twisting tool 31 including a triaxial multidisk temporary twisting device through a first heater 41 and a cooling plate 43. A twist drawn to the yarn bar Y at a predetermined magnification between the first feed roller and the second feed roller and retroacting from the temporary twisting tool 31 along the yarn bar Y is thermally fixed by the first heater 41 and is cooled by the cooling plate 43, and is then untwisted in the emporary twisting tool 31, and is thereafter wound upon the winding device 51 through the second heater 35.

In such a device, the winding device 51 faces the worker passage A. Therefore, it is very hard to automatically doff a package P wound upon the winding device 51 through the autodoffer.

As a countermeasure, an arrangement shown in FIG. 2(*b*) is proposed. More specifically, the winding device 51 faces the temporary twisting and relaxation heat treating device 30 carrying the temporary twisting tool 31 and the second heater 35 and the worker passage A is provided therebetween, and a passage B on which the autodoffer for automatic doffing can run is provided between the winding device 51 and the creel stand 10.

In the device shown in FIG. 2(*b*), the yarn bar Y treated by the second heater 35 runs under a working floor of the worker passage A, and is wound upon a bobbin through the winding device 51. In the device shown in the drawing, the first feed roller 27 is provided above the winding device 51, and the worker standing on the worker passage A can carry out the winding work.

For example, however, in the case in which the yarn bar Y which has not been thermally fixed by the first heater 41 is to be subjected to a special processing, that is, preheating, the device shown in FIG. 2(*b*) is not available. In such a case, for example, a device shown in FIG. 2(*c*) is applied. In the device shown in FIG. 2(*c*), a first prefeed roller 21 and a pin type preheater 23 are provided on the upstream side of the first feed roller 27.

In this case, the first prefeed roller 21 and the preheater 23 are provided. Consequently, a yam passage from the first feed roller 27 is protruded into the worker passage A toward the temporary twisting and relaxation heat treating device 30 by an installation of the preheater 23. Moreover, in the case in which the pin type preheater 23 is to carry out the preheating, the yam bar Y cannot be brought into an overfeed state and applicable conditions are restricted.

As a countermeasure, the preheater 23 which is not of a pin type is provided separately as shown in FIG. 2(*d*). The preheater 23 is provided between the winding device 51 and the creel stand 10.

In this device, the overfeed state can be set in the preheater 23. However, it is necessary to carry out the winding work through cooperation of two workers, that is, a worker in the vicinity of the preheater 23 and a worker around the first heater 41. Consequently, a workability is deteriorated. In addition, an installation area is very increased. For this reason, equipment cannot be utilized effectively.

SUMMARY OF THE INVENTION

In consideration of the problems of the related device described above, it is an object of the invention to provide a layout of a drawing and temporary twisting device capable of winding a yarn upon a first feed roller, a first heater and a second heater by one worker, resulting in a very great workability.

Furthermore, it is an object of the invention to provide a layout of a drawing and temporary twisting device in which a yarn can be wound upon a prefeed roller, a preheater, a first feed roller, a first heater and a second heater by one worker also in the case in which a preheater is provided, resulting in a very great workability and a great installation efficiency.

It is an object of the invention to provide a drawing and temporary twisting device capable of carrying out preheating in the preheater in an overfeed state.

Furthermore, it is an object of the invention to provide a drawing and temporary twisting device capable of using both the preheating and the second heater at the same time.

A first aspect of the invention is directed to a drawing and temporary twisting machine wherein a yarn feeding device including a first feed roller for drawing a yarn bar from an original yarn package is provided opposite to a temporary twisting and relaxation heat treating device including a second feed roller having a higher circumferential speed than that of the first feed roller and a temporary twisting tool for twisting the yarn bar and a second heater for carrying out a relaxation heat treatment on a temporary twisted yarn bar with a worker passage interposed therebetween, a first heater and a cooling plate which thermally fix a twist retroacting along the yarn bar are provided in portions positioned above from the yarn feeding device to the temporary twisting and relaxation heat treating device, and a winding device including an automatic switching device is provided on an opposite worker passage side of the temporary twisting and relaxation heat treating device. Thus, the first object can he achieved.

Furthermore, a second aspect of the invention is directed to a drawing and temporary twisting machine wherein a yarn feeding device including a preheater for preheating a yarn bar, a first prefeed roller for drawing the yarn bar from a yarn package and a first feed roller is provided opposite to a temporary twisting and relaxation heat treating device including a second feed roller having a higher circumferential speed than that of the first feed roller and a temporary twisting tool for twisting the yarn bar and a second heater for carrying out a relaxation heat treatment on a temporary twisted yarn bar with a worker passage interposed therebetween, a first heater and a cooling plate which thermally fixes a twist retroacting along the yarn bar are provided in portions positioned above from the yarn feeding device to the temporary twisting and relaxation heat treating device, and a winding device including an automatic switching device is provided on an opposite worker passage side of the temporary twisting and relaxation heat treating device. Thus, the first to fourth objects can be achieved.

Moreover, a third aspect of the invention is directed to the drawing and temporary twisting machine wherein a yarn feeding pipe may be provided between the original yarn package and an upstream position of the first feed roller or the preheater, and a yarn cutter is provided in the vicinity of a first feed roller side (that is, a first feed roller or preheater side) end of the yarn feeding pipe.

By such a structure, when first yarn winding is to be carried out, a worker puts the yarn end drawn from the original yarn package mounted on a creel stand on the end of the yarn feeding pipe at the original yarn package side. Next, the same worker goes to the worker passage or another worker in the worker passage carries out suction from the yam feeding pipe end on the opposite original yarn package side (that is, the first feed roller or preheater side) through a suction gun. Consequently, a yarn end can easily be drawn from the original yarn package of the creel stand and can be wound upon the first feed roller or the preheater.

By the structure, moreover, in the case in which there is a hindrance on the downstream of the first feed roller or the preheater during the regular operation of the drawing and temporary twisting device according to the invention, the yarn cutter operates to cut the yarn bar and the yarn end thus cut is positioned in the vicinity of the first feed roller side end of the yarn feeding pipe. Consequently, the worker which knows the operation of the yam cutter (that is, the generation of the hindrance in the drawing and temporary twisting device) can easily wind the yarn again in accordance with the normal yam winding procedure.

According to the second or sixth aspect of the invention, moreover, the winding device may have the yarn sucking port in each weight and the yarn delivery device may be provided between the downstream position of the second heater and the vicinity of the yarn sucking port of the winding device. The worker in the worker passage brings the yam bar drawn from the second heater to the yarn delivery device on the downstream position side of the second heater of the yarn delivery device. The yam delivery device delivers the yam bar to the yarn sucking port by the action of compressed air, and the yarn bar sucked into the yam sucking port is automatically wound upon the winding device through the automatic switching device included in the winding device and is wound onto the bobbin.

According to the fourth, seventh or eighth aspect of the invention, furthermore, it is preferable that the second heater and/or the preheater according to the invention should be a high temperature non-contact type heater capable of carrying out heating to a maximum temperature of 600° C.

The present disclosure relates to the subject matter contained in Japanese patent application No. 2000-38796 (filed on Feb. 16, 2000), which is expressly incorporated herein by reference in its entirety.

BRIEF DESCRIPTION OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

DETAILED DESCRIPTION OF THE INVENTION

Figure 1:
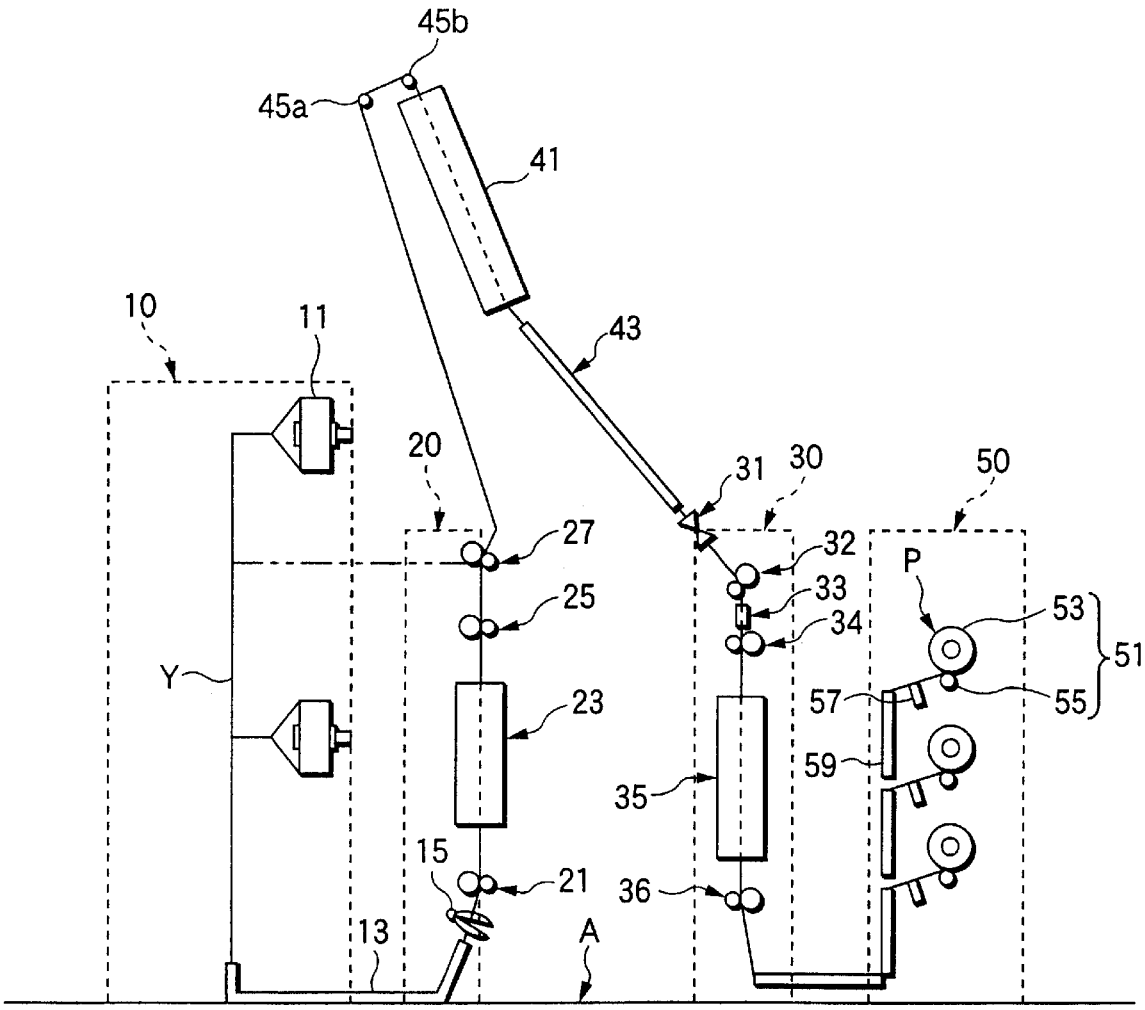
FIG. 1 is a schematic front view showing an embodiment of the invention, and FIGS. 2(*a*) to (*d*) are schematic views showing related devices, respectively.
Figure 2A:
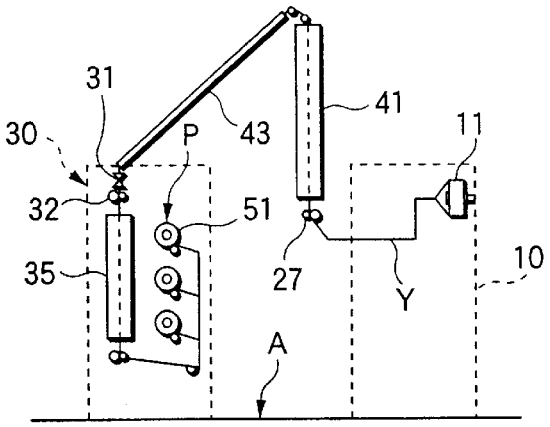
Figure 2B:
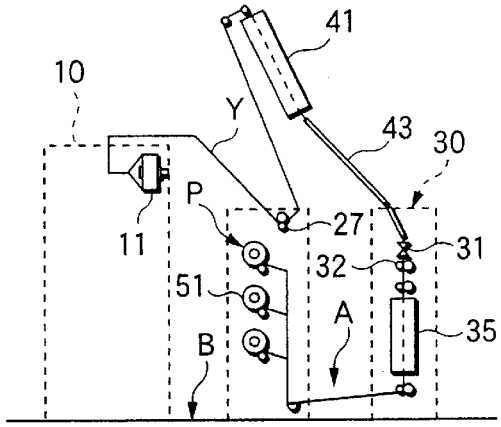
PRIOR ART FIG.2(b)
Figure 2C:
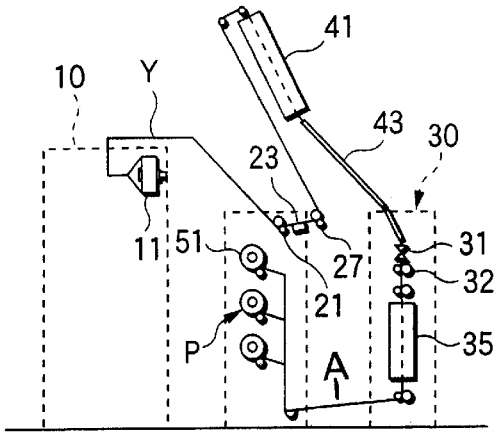
PRIOR ART FIG.2(c)
Figure 2D:
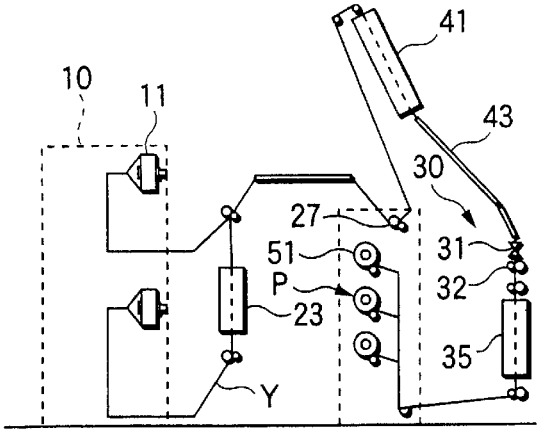
PRIOR ART FIG.2(d)

The invention will be described below in detail with reference to the accompanying drawings. FIG. 1 shows an embodiment of the invention. In FIG. 1, the reference numeral 10 denotes a creel stand 10. The creel stand 10 carries a large number of original yam packages 11. A yarn feeding and preheating stand 20 is provided close to the creel stand 10.

The yarn feeding and preheating stand 20 has a first prefeed roller 21 provided in a lower portion, a preheater 23 provided above the first prefeed roller 21, a second prefeed roller 25 provided on the upper side of the preheater 23, and a first feed roller 27 provided above the second prefeed roller 25.

A yarn feeding pipe 13 is provided between the creel stand 10 and the first prefeed roller 21, and a worker puts an end of a yarn bar Y pulled out of the original yam package 11 on an inlet of the yarn feeding pipe 13 at the creel stand 10 side. The worker moves to a worker passage A which will be described below or another worker present in the worker passage A carries out suction through a suction gun on the opposite side of the yarn feeding pipe 13. Consequently, the yarn bar Y can be drawn through the yarn feeding pipe 13.

A temporary twisting and relaxation heat treating stand 30 is provided opposite to the yarn feeding and preheating stand 20 with the worker passage A interposed therebetween.

The temporary twisting and relaxation heat treating stand 30 is provided with a temporary twisting tool 31 including a triaxial multiplate temporary twisting device, a second feed roller 32, an interlace nozzle 33 for entangling the yarn bar Y to give collecting properties, and a third feed roller 34 in an upper portion, and a second heater 35 is provided under the third feed roller 34. Furthermore, a fourth feed roller 36 is provided under the second heater 35.

In the embodiment, a circumferential speed of the second feed roller 32 is higher than that of the first feed roller 27 described above, and the yarn bar Y is drawn therebetween.

A first heater 41 and a cooling plate 43 are provided in an upper position between the yam feeding and preheating stand 20 and the temporary twisting and relaxation heat treating stand 30, and a twist given from the temporary twisting tool 31 and retroacting along the yarn bar Y is thermally fixed by the first heater 41 and the yarn bar Y is cooled by the cooling plate 43 together with the temporary twisting tool 31. The reference numerals 45*a* and 45*b* denote a yarn guide for guiding a yam passage between the first feed roller 27 and the first heater 41.

In the above-mentioned embodiment, the first heater 41 and the cooling plate 43 are provided to be inclined downward from the upper portion of the yarn feeding and preheating stand 20 toward the temporary twisting and relaxation heat treating stand 30. It is sufficient that the first heater 41 and the cooling plate 43 are provided in portions positioned above the yarn feeding and preheater stand 20 and the temporary twisting and relaxation heat treating device 30. For example, the first heater 41 may be provided vertically on an extended line of the yarn feeding and preheating stand 20 or may also be provided almost horizontally above both stands 20 and 30.

A winding stand 50 is provided on the opposite worker passage A side opposite to the temporary twisting and relaxation heat treating base 30. A winding device 51 is provided on the winding stand 50 in multistage. The winding device 51 is constituted by a traverse device 55 and a cradle 53 holding a winding bobbin and includes an automatic switching device (not shown).

A yarn sucking port 57 is provided in the vicinity of each winding device 51. A delivery device 59 such as a yarn pipe for delivering a yarn bar by the action of compressed air is provided between the yarn sucking port 57 and a fourth feed roller 36 provided below an outlet of the second heater 35. A yarn brought to an inlet of the delivery device 59 on the downstream of the second heater 35 is fed to the yarn sucking port 57 by the action of the compressed air. The yarn bar Y fed to the yarn sucking port 57 is automatically wound by the automatic switching device included in the winding device 51.

In the embodiment shown in FIG. 1, the preheater 23 and the second heater 35 can be heated to a temperature of 600° C. or more, and a high temperature non-contact type heater for heating in non-contact with the yarn bar Y is used. Depending on the circumstances, a high temperature non-contact type heater may be used to carry out preheating through a pin type heater. Moreover, the second heater 35 of a pipe type may be employed as the second heater 35 in place of the high temperature non-contact type heater. In the second heater 35 of a pipe type, a maximum temperature is approximately 250° C.

In the device according to the invention, furthermore, the yarn bar Y which runs to the first feed roller 27 through the first prefeed roller 21, the preheater 23 and the second prefeed roller 25 and is preheated as shown in a solid line in FIG. 1 and the yarn bar Y which directly runs from the creel stand 10 to the first feed roller 27 and is not preheated as shown in a two-dotted chain line in FIG. 1 may be collected and supplied. In this case, an interlace nozzle may be properly provided to entangle both collected yarn bar Y.

In the invention, moreover, a yarn cutter 15 is provided between the first prefeed roller 21 and the yarn feeding pipe 13. In the case in which there is a hindrance in any portion of the drawing and temporary twisting device on the downstream of the yarn cutter 15, the yarn cutter 15 acts to cut the yarn bar Y and to stop the feed of the yarn bar Y. In such a case, it is preferable that the worker should stand on the worker passage A to such a yarn end in the yan cutter 15 by using the suction gun (not shown) and to sequentially wind the yam upon each member of the drawing and temporary twisting device.

According to the invention, only one worker standing on the worker passage A can wind the yarn bar pulled out of the original yarn package from the first feed roller to the second heater. In the invention, moreover, the winding device includes the automatic switching device. Therefore, only the worker in the worker passage can wind the yam upon the winding device. Furthermore, also in the case in which the preheater is used, one worker can carry out a yam winding work. Therefore, a very great workability can be obtained.

In the apparatus according to the invention, there is provided a drawing and temporary twisting machine capable of installing a preheater without considerably increasing the size of the machine and having a great installation efficiency. In the apparatus according to the invention, moreover, the winding device is provided on the opposite worker passage side of the temporary twisting and relaxation heat treating device. Therefore, a running space for an autodoffer can be maintained, and the autodoffer can easily be introduced to doff a package from the winding device.

In the invention, in the case in which the high temperature non-contact type heater is employed as the preheater, a portion of the high temperature contact heater can be brought into an overfeed state and a heat treatment can be carried out by a low tension. Consequently, a higher speed processing than that of the pin type heater can be obtained.

Similarly, in the case in which the high temperature non-contact type heater for the second heater is employed, a high speed processing potential is more increased than that in a related pipe type contact heater.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A drawing and temporary twisting machine wherein a yarn feeding device including a first feed roller for drawing a yarn bar from an original yarn package provided opposite to a temporary twisting and relaxation heat treating device including a second feed roller having a higher circumferential speed than that of the first feed roller, a temporary twisting tool for twisting the yarn bar and a second heater for carrying out a relaxation heat treatment on the temporary twisted yarn bar, a worker passage interposed in between the yarn feeding device and temporary twisting and relaxation heat treating device, a first heater and a cooling plate which thermally fix a twist retroacting along the yarn bar are provided in portions positioned above from the yarn feeding device to the temporary twisting and relaxation heat treating device, and a winding device including an automatic switching device located such that the temporary twist and relaxation heat treating device is positioned between the worker passage and the winding device.

2. The drawing and temporary twisting machine according to claim 1, wherein a yarn feeding pipe is provided between the original yarn package and an upstream position of the first feed roller, and a yarn cutter is provided in the vicinity of a first feed roller side end of the yarn feeding pipe.

3. The drawing and temporary twisting machine according to claim 1, wherein the winding device has a yarn sucking port on each weight and a yarn delivery device is provided between a downstream position of the second heater and the vicinity of the yarn sucking port of the winding device.

4. The drawing and temporary twisting machine according to claim 1, wherein the second heater is a high temperature non-contact type heater which can carry out heating to a maximum temperature of 600° C.

5. A drawing and temporary twisting machine wherein a yarn feeding device including a preheater for preheating a yarn bar, a first prefeed roller for drawing the yarn bar from a yarn package and a first feed roller is provided opposite to a temporary twisting and relaxation heat treating device including a second feed roller having a higher circumferential speed than that of the first feed roller, a temporary twisting tool for twisting the yam bar and a second heater for carrying out a relaxation heat treatment on the temporary twisted yarn bar, a worker passage interposed in between the yarn feeding device and temporary twisting and relaxation heat-treating device, a first heater and a cooling plate which thermally fix a twist retroacting along the yarn bar are provided in portions positioned above from the yam feeding device to the temporary twisting and relaxation heat treating device, and a winding device including an automatic switching device is provided on an opposite worker passage side of the temporary twisting and relaxation heat treating device.

6. The drawing and temporary twisting machine according to claim 5, wherein a yam feeding pipe is provided between the original yarn package and an upstream position of the preheater, and a yarn cutter is provided in the vicinity of a preheater side end of the yam feeding pipe.

7. The drawing and temporary twisting machine according to claim 5, wherein the winding device has a yarn sucking port on each weight and a yarn delivery device is provided between a downstream position of the second heater and the vicinity of the yarn sucking port of the winding device.

8. The drawing and temporary twisting machine according to claim 5, wherein the second heater is a high temperature non-contact type heater which can carry out heating to a maximum temperature of 600° C.

9. The drawing and temporary twisting machine according to claim 5, wherein the preheater is a high temperature non-contact type heater capable of carrying out heating to a maximum temperature of 600° C.

10. The drawing and temporary twisting machine according to claim 5, wherein a second feed roller is provided between the preheater and the first feed roller.

* * * * *